United States Patent [19]

Schleis

[11] 4,417,726

[45] Nov. 29, 1983

[54] FOOT HOLDDOWN DEVICE FOR PERFORMING SITUPS

[76] Inventor: William J. Schleis, 2420 Ascension Dr., San Ramon, Calif. 94583

[21] Appl. No.: 352,137

[22] Filed: Apr. 22, 1982

[51] Int. Cl.[3] ..... A63B 23/00

[52] U.S. Cl. ..... 272/93; 272/900

[58] Field of Search ..... 272/93, 143, 900, 136, 272/125

[56] References Cited

U.S. PATENT DOCUMENTS

| | | | |
|---|---|---|---|
| 1,969,165 | 8/1934 | Turner | 272/93 |
| 2,050,652 | 8/1936 | Fleming | 272/93 |
| 3,256,015 | 6/1966 | Perrin | 272/136 |
| 3,851,874 | 12/1974 | Wilkin | 272/125 |
| 4,121,825 | 10/1978 | Hult | 272/900 |
| 4,212,458 | 7/1980 | Bizilia | 272/93 |
| 4,251,071 | 2/1981 | Norton | 272/143 |

FOREIGN PATENT DOCUMENTS

| | | | |
|---|---|---|---|
| 842707 | 11/1963 | United Kingdom | 272/900 |

*Primary Examiner*—Richard J. Johnson

[57] ABSTRACT

A portable physical fitness piece of equipment embodying 2 foot stirrups, an anchor, center fist and a teflon covered flexible braided wire bonding anchor and fist. When placed below a bed rail, furniture leg, or between floor and door lower edge (not physically attached by bolts, screws, brackets or other means), designed for the specific purpose of providing means by which the feet of the user (while performing situps) can be held comfortably at near floor level with relative ease, still allowing a comfortable degree of lift/right lateral and vertical movement of feet while performing situps. This device is manufactured of specific materials so as to provide user with a sturdy and reliable, yet inexpensive piece of physical exercise equipment which can be adapted in its use (anchored) to a multitude of objects.

3 Claims, 2 Drawing Figures

FOOT HOLDDOWN DEVICE FOR PERFORMING SITUPS

In support of the general trend toward physical fitness as has been the center of focus in this country the past several years, this invention, used in the art of physical fitness and referred herein as a "Foot/Ankle hold-down device" was conceived and designed primarily to provide a durable, yet compact piece of equipment for exercising, concentrating on leg and midsection of the body used in conjunction with performing situps. In performing situps, it is desirable to restrict, snubdown or hold the feet at floor level to preclude the feet from rising when the upper body is raised from a flat position lying on the back to a sitting position. This invention is unique in that it is a very simple piece of equipment which was designed to eliminate the need for temporary or permanent attachments prior to or during use, such as screws, bolts or brackets, and no adjustments are necessary. This results in saving valuable time by the user. This self-contained device is constructed of lightweight material, namely wood, nylon rope, and braided plastic coated wire.

OBJECTS OF THE INVENTION

It is an object of this invention to provide a practical, efficient, simply constructed and reasonably inexpensive portable addition to physical exercising equipment which can be used at home, office or by anyone who travels and still desires to participate in his/her daily routine of exercising in the privacy of a hotel room, particularly if other means of conditioning facilities and/or time are not readily available.

A further object is to provide an alternative to bulky equipment thus enabling continuing physical conditioning while traveling utilizing this portable lightweight and compact device.

An associated object is to provide the occasional user who specializes in limited exercising, an inexpensive yet adequate piece of desirable equipment, thus precluding the necessity to purchase or utilize exclusively bulky equipment such as may be found in clinics or gymnasiums, when in fact similar results can be attained using this device and at a fraction of the cost.

DETAILED DESCRIPTION OF THE INVENTION

Figures 1, 2:
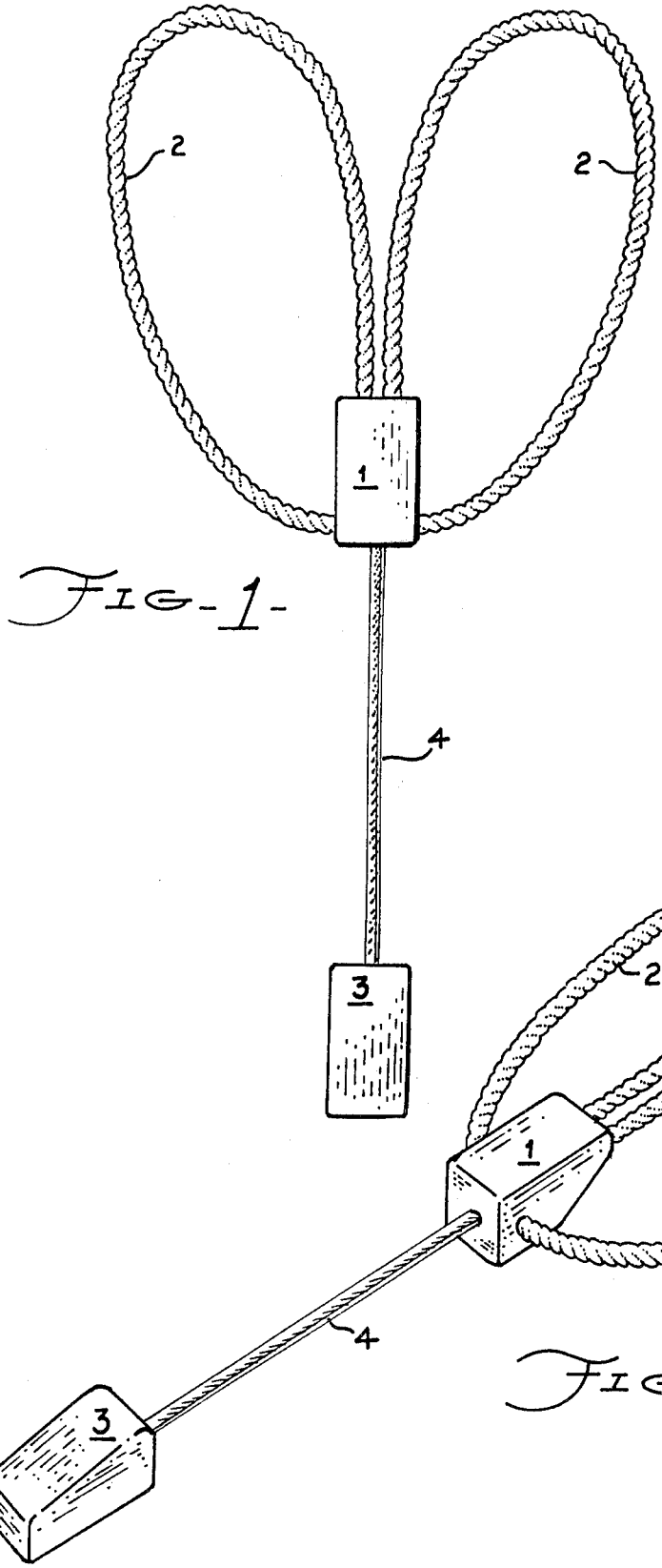
FIG. 1 is a plan view of the invention.
FIG. 2 is a perspective view of the invention.

Twin stirrups 2 are fabricated from three-eighths inch diameter nylon rope material and are attached in side by side relation to the connector block 3. An integral bonding feature unites the ends of the stirrups 2 to the connector block 3. The stirrups provide a secure and comfortable fit individually formed to secure each users feet.

Anchor block 3 is secured to the opposite end of the device from the stirrups 2 by a flexible three-sixteenth inch diameter Teflon or other plastic coated braided steel wire 4. The anchor block 3 can be placed under and behind the supporting element or leg of any piece of furniture with a minimum floor clearance of only the thickness of the braided wire 4 any furniture piece such as a sofa, dresser, recliner chair, bed or any suitable object may be used to clamp or secure the wire 4. It can with relative ease be slipped between the base of any door and floor. With the door opened to approximately three inches the anchor 3 is slipped under the open edge of the door which is then closed. In this position, the anchor block 3 will remain on the opposite side with wire 4 passing through the opening between the door and the floor. When so placed, the device is ready for instant use. The user from a sitting position on the floor simply slips one of his feet in each stirup and immediately commences his situp exercise. The stirrups form a firm but comfortable grip around the top area of the feet just below the ankle, and in about the position of the shoe laces if shoes with laces were worn. Users can utilize this device with or without shoes with the same degree of comfort.

As constructed, the device weighs approximately 6 oz's, is compact when stowed, requiring a space of only about $6'' \times 8'' \times 1\frac{1}{2}''$. It can comfortably be carried in a briefcase by those who travel.

What is claimed is:

1. A physical fitness exercising device specifically designed to support a users feet while engaged in performing exercises performed from a position flat on the back to a sitting position said device comprising;

a pair of side-by-side loops of flexible rope secured within a central connector block, each loop forming a stirrup which is adapted to receive the foot of a user, a flexible connecting means secured at one end to said connector block and at its opposite end to an anchor block, said anchor block and connecting means being adapted to be secured under a door or clamped under on article of furniture while the user performs sit-up type exercises with a foot in each stirrup.

2. The invention described in claim 1 above wherein said connecting means comprises a Teflon covered braided wire material.

3. The invention described in claim 1 above wherein the stirrups are constructed from nylon rope.

* * * * *